US009783954B1

(12) United States Patent
Justice

(10) Patent No.: US 9,783,954 B1
(45) Date of Patent: Oct. 10, 2017

(54) SINGLE LINE BUCKET

(71) Applicant: Elden Monroe Justice, Kellysville, WV (US)

(72) Inventor: Elden Monroe Justice, Kellysville, WV (US)

( * ) Notice: Subject to any disclaimer, the term of this patent is extended or adjusted under 35 U.S.C. 154(b) by 56 days.

(21) Appl. No.: 15/041,855

(22) Filed: Feb. 11, 2016

(51) Int. Cl.
*E02F 3/60* (2006.01)
*B65D 88/56* (2006.01)

(52) U.S. Cl.
CPC ..... *E02F 3/60* (2013.01); *B65D 88/56* (2013.01)

(58) Field of Classification Search
CPC B60K 15/06; B65D 88/56; B66C 3/00; E02F 9/14; E02F 3/308; E02F 3/60; E02F 3/54; E02F 3/58; E02F 3/46; E21C 27/30
USPC ..... 37/195, 394, 398, 399, 400, 401, 444; 220/751, 762, 765; 294/68.26, 68.27; 299/18; 414/373, 376
See application file for complete search history.

(56) References Cited

U.S. PATENT DOCUMENTS

| | | | | |
|---|---|---|---|---|
| 1,070,405 A | | 8/1913 | Butler | |
| 1,139,559 A | | 5/1915 | Morris | |
| 1,449,661 A | * | 3/1923 | Forsythe | B65D 88/56 294/68.27 |
| 1,863,458 A | | 6/1932 | Thompson | |
| 2,669,042 A | | 2/1954 | Swank et al. | |
| 2,671,283 A | | 3/1954 | Sights | |
| 2,798,758 A | * | 7/1957 | Yakopec | B60K 15/06 220/751 |
| 3,230,003 A | | 1/1966 | Mcafoos, Jr. et al. | |
| 3,374,907 A | * | 3/1968 | Phillips | B65D 88/56 294/68.27 |
| 5,561,922 A | | 10/1996 | Lynch | |
| 5,641,188 A | | 6/1997 | Phillips | |
| 6,432,303 B1 | | 8/2002 | Chesner et al. | |
| 7,658,023 B2 | | 2/2010 | Wallett | |
| 7,685,749 B2 | | 3/2010 | Loeffelholz et al. | |
| 7,721,473 B2 | | 5/2010 | Lunn | |
| 8,112,912 B2 | | 2/2012 | Doan | |
| 2009/0235560 A1 | | 9/2009 | Lumley | |

FOREIGN PATENT DOCUMENTS

| | | |
|---|---|---|
| EP | 0487879 A1 | 6/1992 |

* cited by examiner

*Primary Examiner* — Robert Pezzuto
(74) *Attorney, Agent, or Firm* — Johnston Holroyd; Mary-Jacq. Holroyd

(57) ABSTRACT

A single line bucket which has a first position in which the opening of the scoop is disposed downward and the arm and crossbar are retained by a cam latch, and a second position in which the cross bar are released and the scoop of the bucket extends therebeneath with the scoop opening upward retaining material within.

20 Claims, 6 Drawing Sheets

SINGLE LINE BUCKET

BACKGROUND OF THE INVENTION

Crane operated single line scooping apparatuses and buckets are known, but they are quite complicated, and frequently require hydraulics to function. U.S. Pat. No. 2,671,283 teaches a scooping apparatus that uses a single line, and a very creative pneumatically controlled roller scoop which also uses extendable counter arms to aid in digging. Most of such devices make use of two buckets that meet forming clam buckets. Similarly, U.S. Pat. No. 5,561,922 teaches an extraction dredging apparatus which has a clam shell scoop at the end of a pneumatically controlled mechanism that can clearly be suspended from a single line. U.S. Pat. No. 6,432,303 teaches a contaminated sediment excavator for subsurface sediment removal that has a clam bucket which uses two opposing shells dangled from a single overhead line. U.S. Pat. No. 7,685,749 teaches a soil stripping device which is basically a clam bucket on a single line with a support platform and carrier implement.

Hauling and moving apparatuses, as well as, buckets or containers that have arms with load bearing crossbars or similar arrangements exist. EP 0 487 879 A1 shows a transportation apparatus that dangles from a single chain attached to a pivotal crossbar for moving cargo, supplies, or work materials. U.S. Pat. No. 2,669,042 teaches a drag scoop for hauling "riprap", which scoop has arms and a cross bar of sorts that do not pivot, but also uses a lift chain and a drag chain arrangement to scoop up loose material. U.S. Pat. No. 1,863,458 teaches a bucket with pivotal arms and a cross bar, which also has teeth on a scoop part. U.S. Pat. No. 7,658,023 teaches a bucket for a mechanical shovel that uses bar support on a chain or single line, which also uses an hydraulic arm in place of a secondary chain, or in addition thereto, that runs along the same line as a conventional drag chain.

Dragline buckets are known. Dragline buckets use a single bucket instead of a clam shell or pneumatics, but they require multiple lines, which may operate to drag the bucket across the bottom of a body of water, or across loose materials. An example, U.S. Pat. No. 7,721,473 teaches a dragline excavator bucket, and demonstrates the line attachments set up for use with a crane in which two lines extend upwards to the crane boom and one or two lines extend from the crane base to control the dragging action for the bucket to function. Another example, US Patent Application No. 2009/0235560 A1 teaches a dragline bucket comprising a floor with a ground engaging leading edge which may have a row of teeth, and two spaced apart side walls extending from the floor and forward from a rear wall. U.S. Pat. No. 8,112,912 teaches a dump block with improved assembly features and the chain arrangement for such devices when hooked to a crane boom and to the base of the crane.

SUMMARY OF THE INVENTION

The present invention is drawn to a single line bucket that is lowered, typically by a crane, into a soft or loose material. The single line bucket operates generally in two positions, a first position in which the opening of the scoop is disposed downward and the arm/bar are retained by a cam latch, and a second position in which the arm/bar are released and the bucket extends therebeneath with the scoop opening upward retaining material within the scoop. The bottom or floor of the single line bucket may be composed of a door or two doors through which to release the contents of the single line bucket. Alternatively, a mechanism may extend from the bottom floor of the bucket to catch upon another edge, e.g., the side of a dump truck, or to provide a dump bar to manually dump the load.

Upon contact with the loose material the bucket moves to scoop up the loose material by action of gravity releasing the cam latch. A pair of extensions, which may have a dump bar therebetween, are disposed opposite one another at the base or floor of the bucket to catch the sides of a dump truck, or similar material collection device. The dump bar may also be operated manually. The single line bucket is reset manually, or configured with an electromagnet to return the bucket to proper position with the arms retained in the scoop position when the bucket is dumped. The bucket could alternatively be designed with a chain/line, or hydraulic mechanism, to return the bucket back into scooping position.

Aspects of the present invention include the simplicity of the bucket. The invention does not require multiple lines to function, nor does it require pneumatics or the like.

Another aspect of the present invention is that it functions with just a single line and can be used by one person with a crane.

A further aspect of the present invention is that some embodiments have few parts and are therefore hard to break and easy to repair.

These and other aspects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

Similar reference characters denote corresponding features consistently throughout the attached drawings. The drawings may not be drawn to scale with the relative sizes of smaller parts being exaggerated for clarity.

DETAILED DESCRIPTION OF PREFERRED EMBODIMENTS

Figure 1:
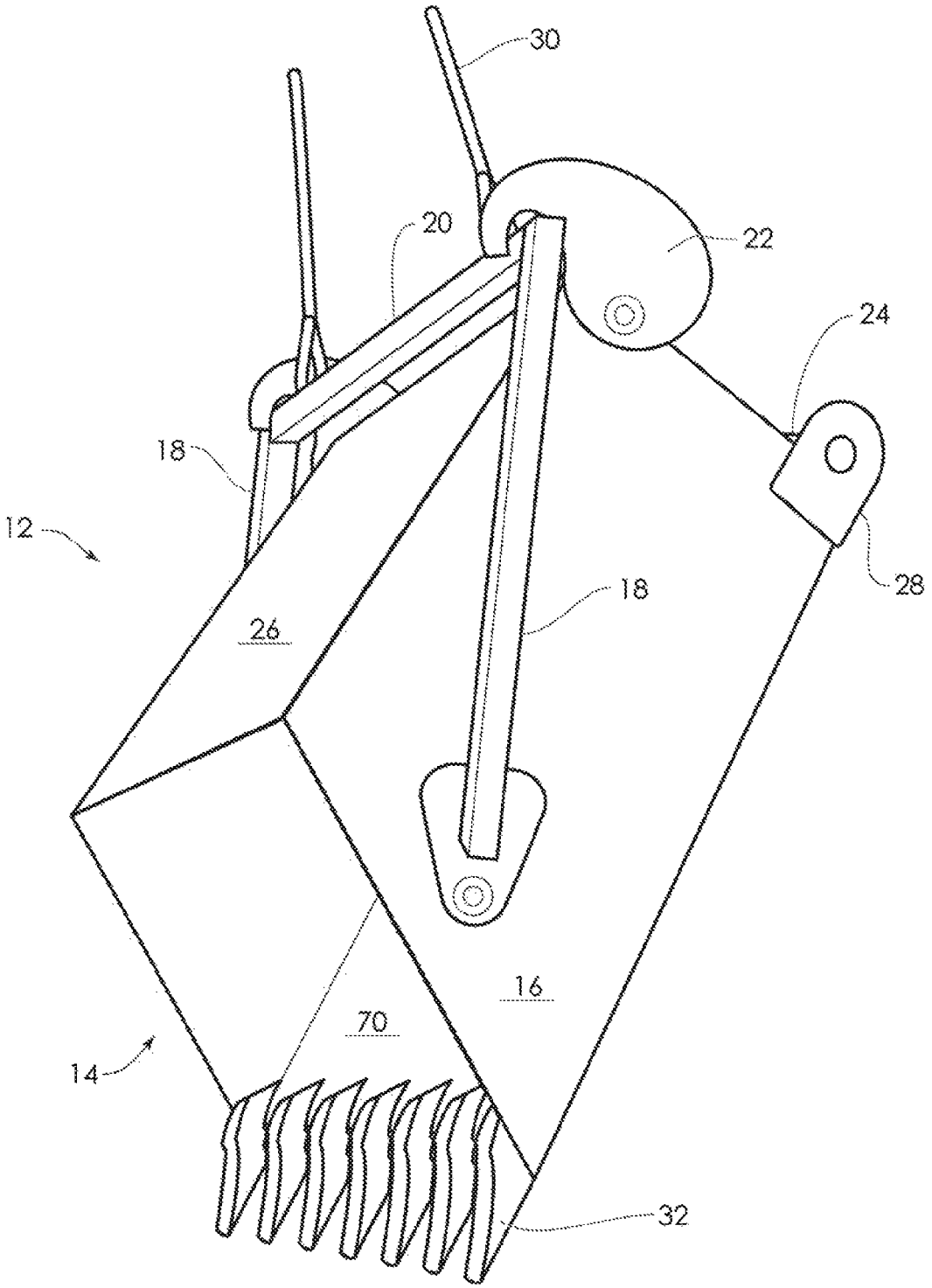
FIG. 1 shows perspective view of a single line bucket according to an embodiment of the present design in a first position disposed to scoop loose material.
Figure 2:
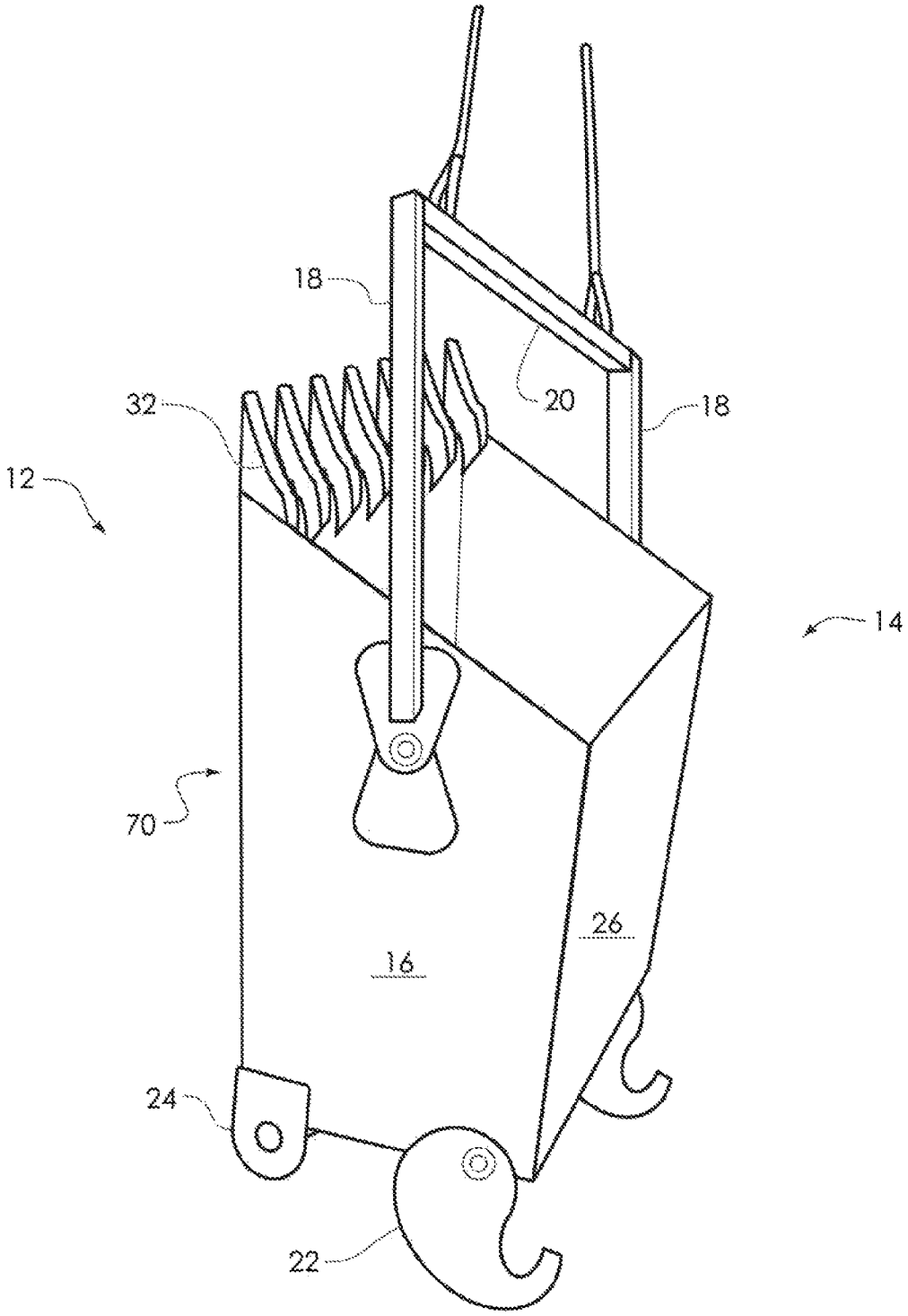
FIG. 2 shows a perspective view of a single line bucket according to an embodiment of the present design in a second position disposed to hold and lift the loose material.

A single line bucket assembly 12 which has a first position, shown in FIG. 1, in which the opening 14 of the scoop 16 is disposed downward with opposing arms 18 ending in a crossbar 20 retained by a cam latch 22, and a second position, shown in FIG. 2, in which the crossbar 20 is released and the scoop 16 of the bucket 12 extends therebeneath with the scoop opening 14 upward retaining material within. The bucket has a floor 46 and an open end 14 as shown forms a container to hold scooped material.

An open scoop bucket 12 that has an open end 14 opposite a floor 46 with sides 16, including a front side 26, a back side 70, and two opposite sides 16, disposed between the open end 14 and the floor 46 forming a container. Opposing arms 18 having a length with one end rotatably attached to the side 16 of the bucket 12, at a pivot point, and the second end attached to a crossbar 20 which extends therebetween. Opposing cam latches 22 are disposed adjacent the floor 46 of the bucket 12 to releasably engage the crossbar 20. Attachments are provided on the crossbar 20 to attach the bucket 12 to a chain or cable 30 to lift the bucket 12, as shown in FIG. 2. A row of teeth 32 are disposed along the opening where the bucket 12 would meet the ground in operation as shown. The bucket may have a rectangular shape with four sides, in which the front side 26 is disposed opposite a back side 70. The teeth 32 are disposed on the back side 70. The back side 70 may be longer than the front 26 with the adjacent sides 16 being tapered along the opening 14 between the front 26 and back 70 sides, as shown.

In operation the scoop bucket 12 is lowered with the opening downward as shown in FIG. 1. Upon contact with loose material the bucket 12 moves to scoop up the loose material by action of gravity releasing the cam latch 22 pivotably attached adjacent the floor 46 of the bucket 12. The single line bucket 12 is reset manually, or configured with an electromagnet 38 and 40 to return the bucket 12 to proper position with the arms 18 retained in the scoop position when the bucket 12 is dumped. The bucket 12 could alternatively be designed with a chain/line, or hydraulic mechanism, to return the bucket 12 back into scooping position. Otherwise, the bucket 12 can be repositioned manually.

Figure 3:
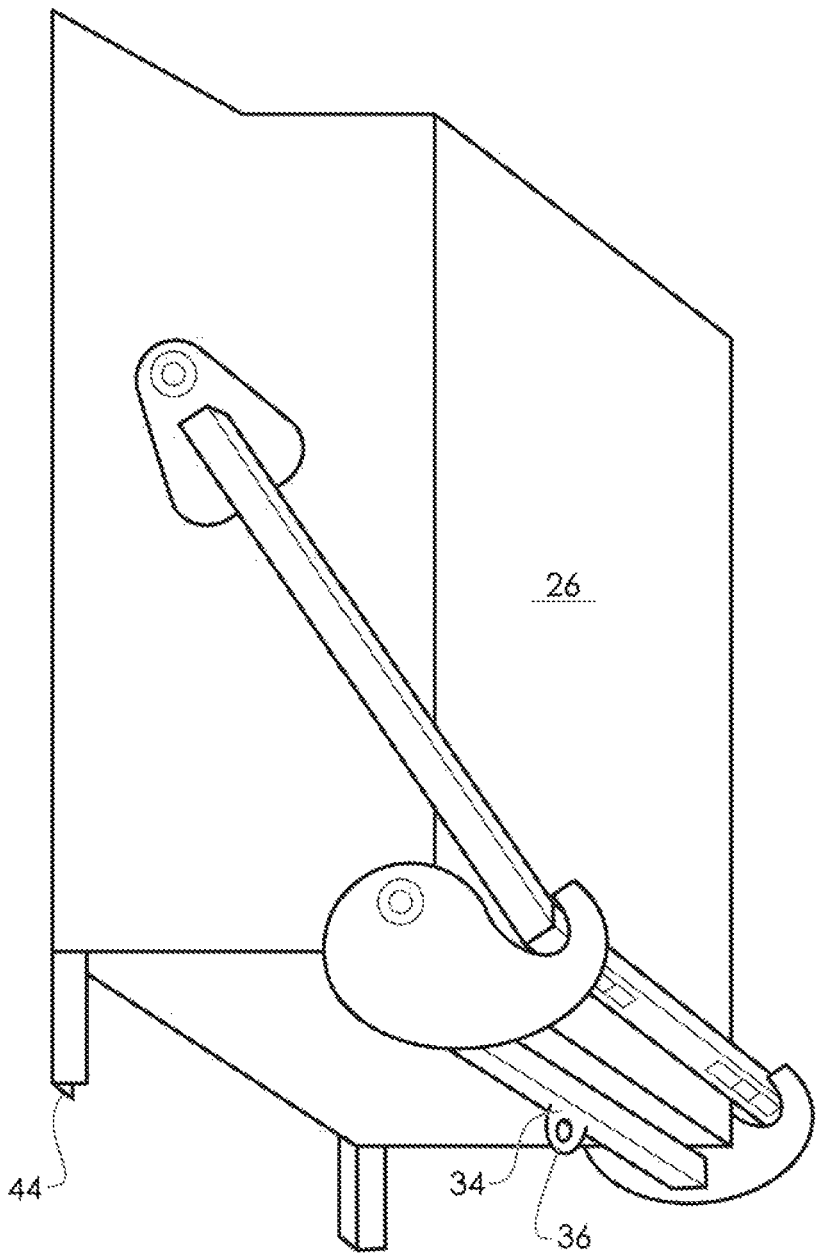
FIG. 3 shows a perspective view of the bottom of an embodiment of the present design (in the first position) showing alternative aspects thereof.

FIG. 3 also shows the dump extensions 44 which in a practiced embodiment are composed of two iron angle rods, as shown, that catch the side of a dump truck or vessel to facilitate dumping the contents from the container bucket. In another embodiment, the extensions are braces 28 designed to hold a dump bar 24 that is used either to catch the side of a dump truck or be manually grabbed to dump out the contents of the bucket 12. The dump bar 24 is disposed across the base of the bucket 12 which catches the sides of a dump truck or similar material collection device.

Figure 4:
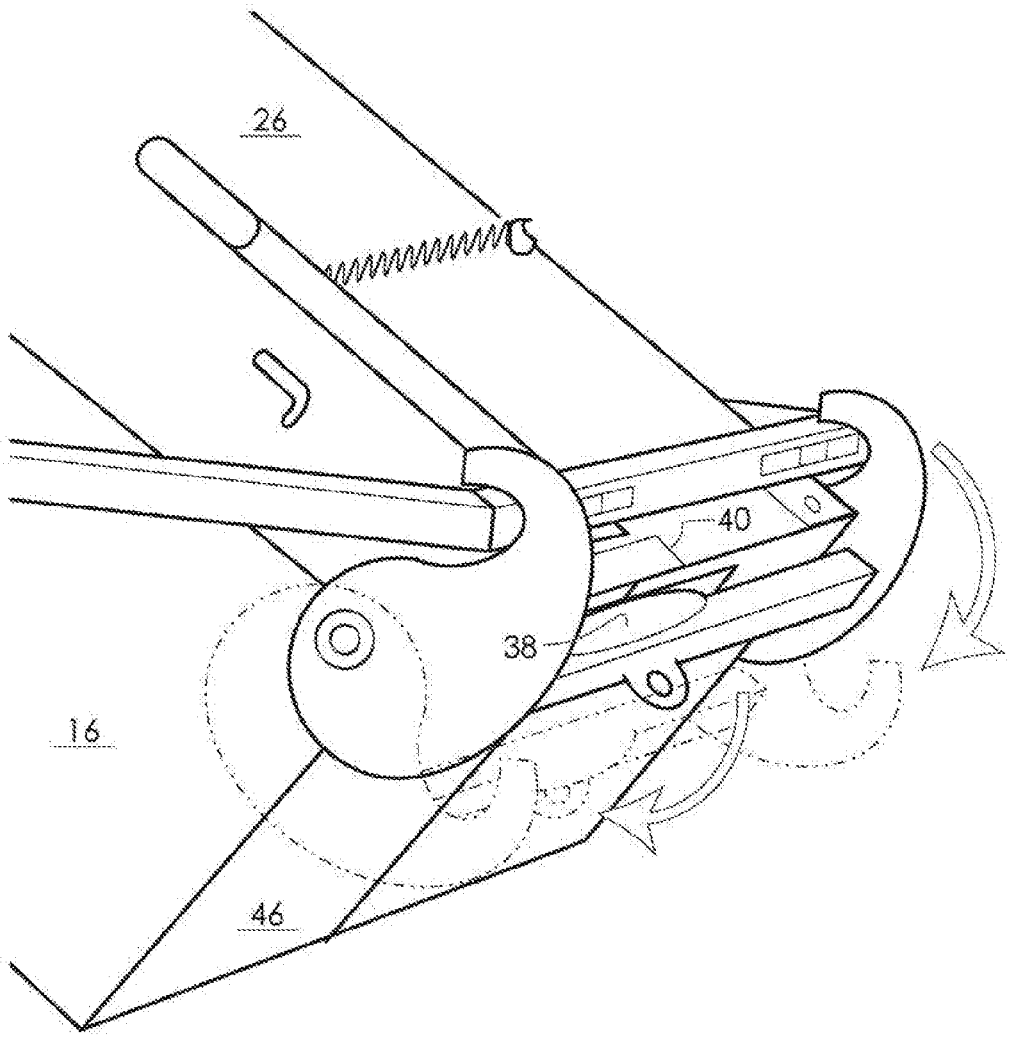
FIG. 4 shows a diagram of another embodiment of the present design (in the first position) showing the cam latch mechanism in more detail.
Figure 5:
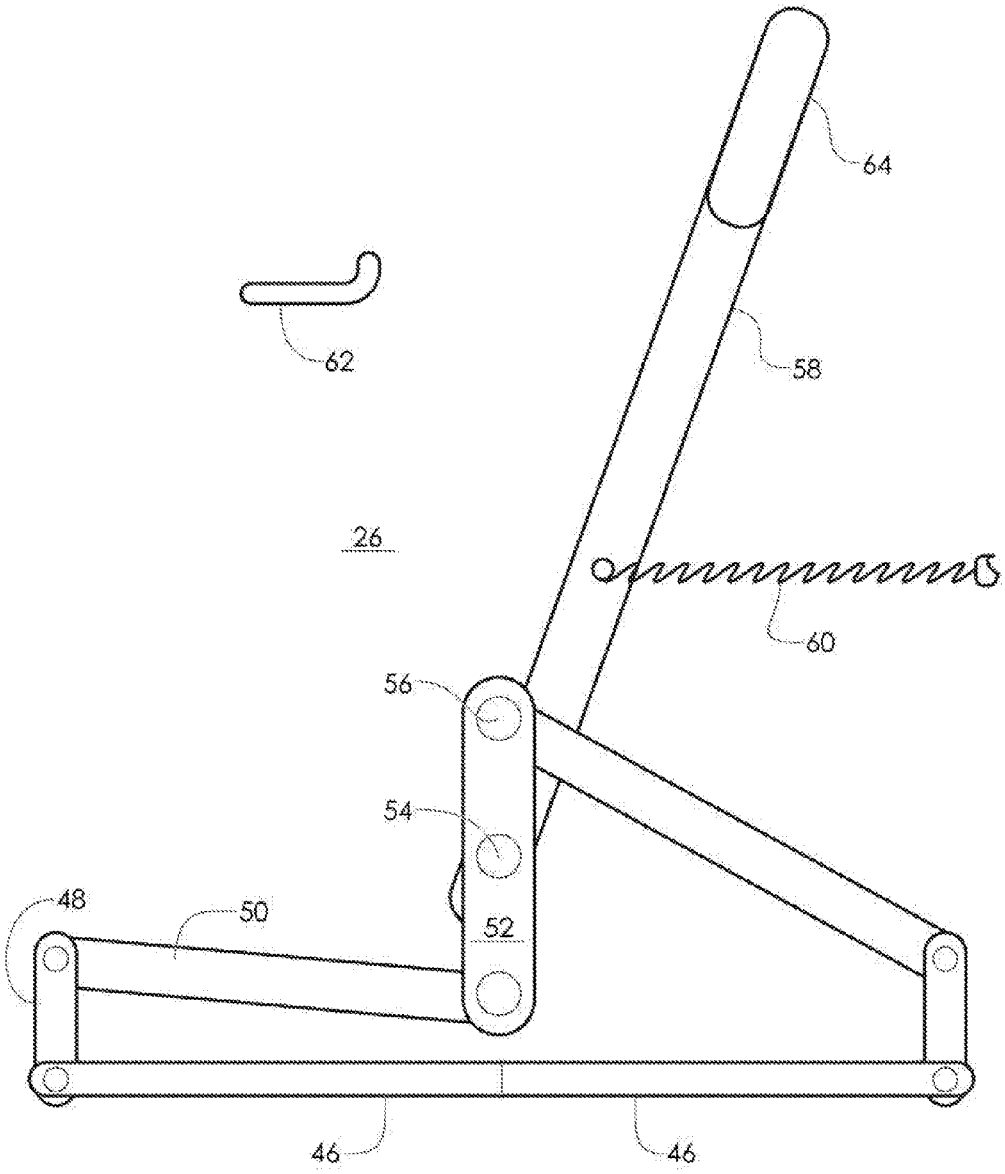
FIG. 5 shows a plan view of a mechanism to empty the single line bucket according to an embodiment of the present design.
Figure 6:
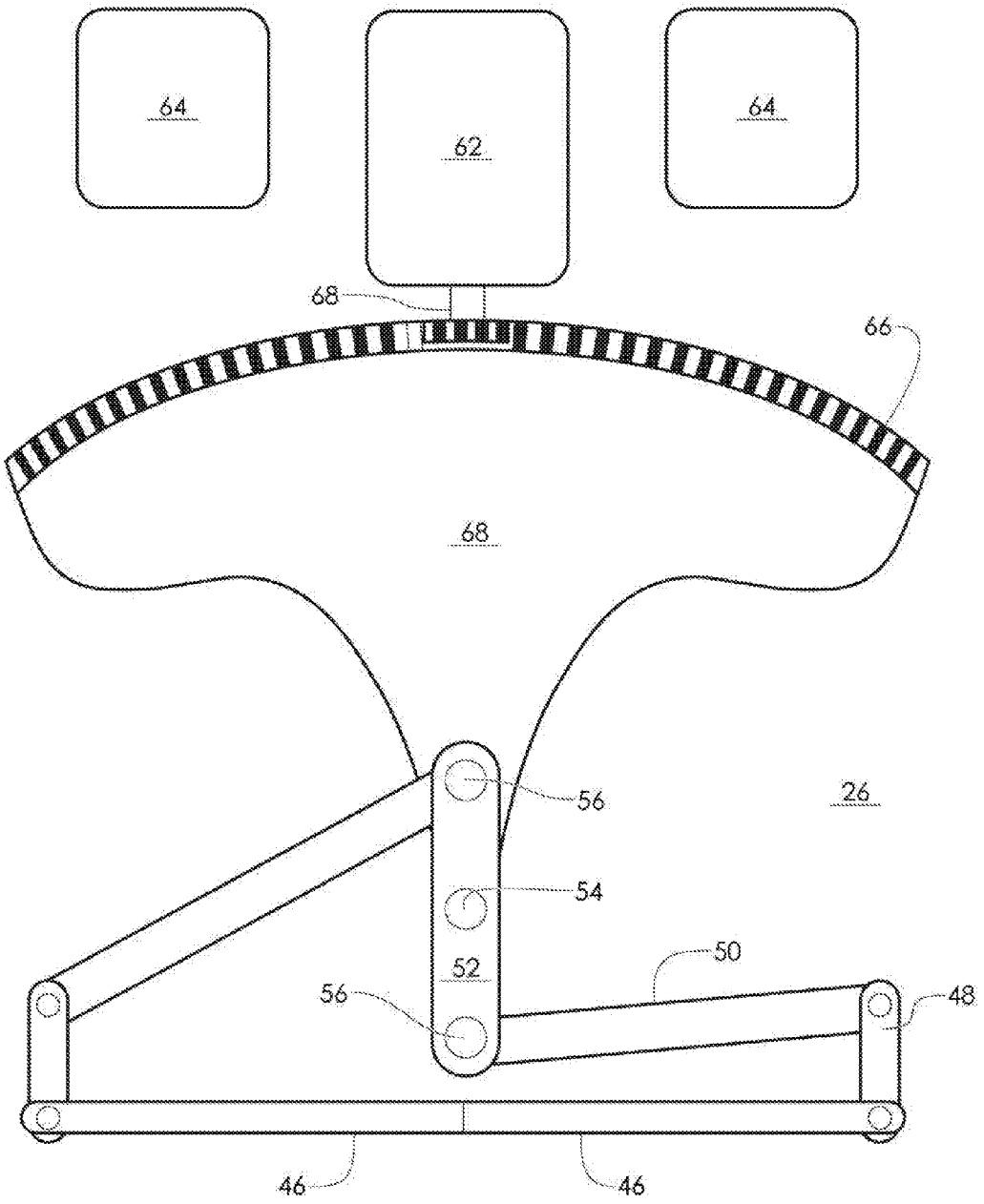
FIG. 6 shows a plan view of a mechanism to empty the single line bucket according to another embodiment of the present design.

FIG. 4 is similar to FIG. 3 except that the mechanism utilized to dump the content of the bucket 12 is that the floor 46 is two opposing doors comprising the bottom of the scoop bucket 12 container. Alternative floor 46 door opening mechanisms are shown in FIGS. 5 and 6 which show two alternative options to open the opposing doors. The embodiment of the present design depicted in FIG. 5 is a manual mechanism in which the handle 64 on an opening bar 58 is disposed in a closed position as shown in FIG. 5. The biasing spring 60 encourages the closing of the bottom floor 46 as shown. Various arms 52, 50, 48 and pivots 56, 54 are attached to the opening bar 58 and the floor 46 doors to pivot them outward to an open position in which the opening bar 58 is retained by a retainer mechanism 62. The open position allows the contents to be dropped therefrom while the closed position retains the contents therein. A biasing spring, and retainer, may be disposed to hold the handle or return the handle to or in a desired position.

FIG. 6 depicts an automated mechanism for opening and closing the opposing doors. Instead of an opening bar 58 and handle 58, an automated interface 68 is used in which has a threaded screw 68 mated with a notched 66 edge that operates to move in a first direction when the screw is rotated or a second opposing direction when the screw is rotated in the opposite direction. The screw 68 is rotated by a motor 62. A controller 64 is attached to a motor 62 which opens/closes the floor doors by rotating a screw mechanism 68 in either an open direction or a closed direction to selectively open or close the floor's doors. Tension on the screw mechanism 68 holds the doors in position relative thereto. Although the present description has the opening mechanism on the front 36 side of the bucket 12, the opening mechanism may also be disposed on any other side 16.

In an alternative of the present design a cam bar 34 extends between the cam latches 22 to aid in returning the cam latches 22 into proper position. The cam bar 34 may have a retainer loop 36 disposed midway on the cam bar 34. An electromagnet 38 or two electromagnets 40 may be disposed midway along the cam bar 34 to bias the cam bar 34 in the retained position when on, and to release it when off.

It is to be understood that the present invention is not limited to the embodiments described above, but encompasses any and all embodiments within the scope of the following claims.

What is claimed is:

1. A single line bucket assembly, comprising:

an open scoop bucket having an open end opposite a floor with sides disposed therebetween forming a container;

the sides of the container including a front side, a back side, and two opposite sides;

two opposing arms each arm having a length with two ends, wherein one end of each arm disposed at a pivot point and pivotably extending from each of the opposite sides of the container towards the open end thereof;

a crossbeam extending between the other ends of the arms;

opposing cams for releasably retaining the crossbeam adjacent the floor of the bucket;

the length of the arms sufficient to reach from the pivot point to the front side adjacent the floor; and retainer attachments disposed on the crossbeam to retain a loader cable or chain.

2. The single line bucket assembly of claim 1, further comprising:

teeth adjoining the opening of the container extending from the back side thereof.

3. The single line bucket assembly of claim 1, further comprising:

opposing dump extensions extending from the floor opposite the cams.

4. The single line bucket assembly of claim 1, further comprising:

opposing dump extensions, with a dump bar disposed therebetween, extending from the floor opposite the cams.

5. The single line bucket assembly of claim 1, wherein:

the floor is composed of two doors extending from the opposing sides that can be selectively opened releasing the contents of the container.

6. The single line bucket assembly of claim 5, wherein:

the doors are selectively opened by a manual mechanism actuated by a handle and pivotal frame to open the opposing doors in a first position and close the opposing door in a second position.

7. The single line bucket assembly of claim 5, wherein:
the doors are selectively opened by a controller connected to a motor powering a rotator that has a threaded screw mated with a mechanism such that the threaded screw is rotated in a first direction to open the opposing doors and a second direction to close the opposing doors.

8. The single line bucket assembly of claim 2, wherein:
the teeth extend from one of four sides of the container in which the side of the container containing the teeth is longer from floor to opening then the other sides forming a scoop edge.

9. The single line bucket assembly of claim 1, further comprising:
a cam bar extending between the cams keeping the retainer attachments inline opposite one another such that the opposing cams will maintain relative position to one another.

10. The single line bucket assembly of claim 9, further comprising:
a retainer loop disposed midway on the cam bar;
the retainer loop for engaging a line or bar to manually position the cams.

11. The single line bucket assembly of claim 9, further comprising:
an electromagnet disposed midway on the cam bar, and on the front side adjacent the floor.

12. A single line bucket assembly, comprising:
an open scoop bucket having an open end opposite a floor with sides disposed therebetween forming a container;
the sides of the container including a front side, a back side, and two opposite sides;
teeth adjoining the open end of the container extending from the back side thereof;
opposing arms each arm having a length with two ends, wherein
one end of each arm disposed at a pivot point and pivotably extending from opposite sides of the container towards the open end thereof;
a crossbeam extending between the other ends of the arms;
opposing cams for releasably retaining the crossbeam adjacent the floor of the bucket;
the length of the arms sufficient to reach from the pivot point to the front side adjacent the floor; and
retainer attachments disposed on the crossbeam to retain a loader cable or chain.

13. The single line bucket assembly of claim 12, further comprising:
opposing dump extensions extending from the floor opposite the cams.

14. The single line bucket assembly of claim 13, further comprising:
a dump bar disposed between opposing dump extensions.

15. The single line bucket assembly of claim 13, wherein:
the teeth extend from one of four sides of the container in which the side of the container containing the teeth is longer from floor to opening then the other sides forming a scoop edge.

16. The single line bucket assembly of claim 12, further comprising:
a cam bar extending between the cams keeping the retainer attachments inline opposite one another such that the opposing cams will maintain relative position to one another.

17. The single line bucket assembly of claim 16, further comprising:
a retainer loop disposed midway on the cam bar;
an electromagnet disposed midway on the cam bar and on the front side adjacent the floor; or
combinations thereof.

18. The single line bucket assembly of claim 12, wherein:
the floor is composed of two doors extending from opposing sides that can be selectively opened releasing the contents of the container.

19. The single line bucket assembly of claim 18, wherein:
the doors are selectively opened by a manual mechanism actuated by a handle and pivotal frame to open the opposing doors in a first position and close the opposing door in a second position.

20. The single line bucket assembly of claim 18, wherein:
the doors are selectively opened by a controller connected to a motor powering a rotator that has a threaded screw mated with a mechanism such that the threaded screw is rotated in a first direction to open the opposing doors and a second direction to close the opposing doors.

* * * * *